United States Patent [19]

Gudgel

[11] 4,291,762

[45] Sep. 29, 1981

[54] APPARATUS FOR RAPIDLY ATTACHING AN INSIDE BLOWOUT PREVENTER SUB TO A DRILL PIPE

[75] Inventor: Howard S. Gudgel, Tulsa, Okla.

[73] Assignee: Drill Tech Equipment, Inc., Tulsa, Okla.

[21] Appl. No.: 113,385

[22] Filed: Jan. 18, 1980

[51] Int. Cl.[3] ..... E21B 19/16

[52] U.S. Cl. ..... 166/85; 285/24

[58] Field of Search ..... 166/77.5, 85; 285/24, 285/31, 36

[56] References Cited

U.S. PATENT DOCUMENTS

| | | | |
|---|---|---|---|
| 1,635,749 | 7/1927 | Hosmer | 166/85 |
| 1,822,140 | 9/1931 | Gallaher | 166/85 |
| 2,147,002 | 2/1939 | Volpin | 166/85 |
| 2,517,870 | 8/1950 | Gump | 166/85 |

*Primary Examiner*—James A. Leppink

*Attorney, Agent, or Firm*—Head and Johnson

[57] ABSTRACT

An apparatus is provided for use on a drilling rig for rapidly attaching a blowout preventer sub to the upset female threaded end of drill pipe, including a collar removably attached to the blowout sub, a horseshoe member slidably positionable on the drill pipe below the upset end and engageable with upset end, a telescoping frame interconnecting the collar and horseshoe member and an arm and linkage means for moving the collar and blowout towards each other so that the blowout preventer sub is brought into engagement with the drill pipe upset end after which the blowout sub may be rotated to threadably engage it with the drill pipe. After threadable engagement of the blowout sub with the drill pipe the attachment means may be removed.

6 Claims, 11 Drawing Figures

APPARATUS FOR RAPIDLY ATTACHING AN INSIDE BLOWOUT PREVENTER SUB TO A DRILL PIPE

BACKGROUND OF THE INVENTION

1. Field of the Invention

This invention relates to inside blowout preventer for use in drilling oil and gas wells. More particularly, the invention relates to apparatus for rapidly attaching a blowout preventer sub having lower male threads to the female threads of a drill pipe.

2. Description of the Prior Art

In drilling oil and gas wells where high pressure zones are likely to be encountered, drilling companies include equipment for closing in a well if a blowout occurs or becomes eminent. The usual drilling procedure is to drill a short distance from the earth's surface such as 200 feet or so and set larger diameter casing which is referred to as surface pipe. Drilling is then continued through the large diameter surface pipe and downward to the maximum depth desired, which may be to great depths exceeding 20,000 feet. Operators typically include blowout preventer devices which are supported at the upper end of the surface pipe and which can be closed to clamp around the exterior of drill pipe in the event of blowout so as to prevent fluid and gases, including drilling mud and materials from the borehole from being blown out in the event a high pressure zone is encountered. Such blowout preventers are a common expedient and are well known.

In addition to closing around the exterior of the drill pipe to prevent the blowout around the annular area between the drill pipe and the interior of the surface pipe, it is also necessary to close off the interior of the drill pipe. Drill pipe for rotary drilling is always tubular since drill mud must be circulated downwardly through it during drilling operations. When high pressure formations are encountered, the same pressure applied to expelled drill mud, fluid and gases externally of the drill pipe is applied to the interior of the drill pipe and therefore some means must be provided for closing the interior of the drill pipe. Such devices are referred to as inside blowout preventers.

The method most commonly practiced for providing inside blowout prevention is the use of a device called an inside blowout sub. Such devices are in effect short lengths of drill pipe which have a male thread on the lower end dimensioned to threadably engage the female thread on the upwardly extending upset end of the drill pipe. The sub has a corresponding female thread on the upper end. The outside diameter is no greater than the outside diameter of the upset end of the drill pipe for which the sub is to be used. Thus after the blowout sub is attached another length of drill pipe may be attached to it and drilling continued or well control actions initiated.

There are two basic types of blowout subs, both of which have the same exterior configuration. In one type a check valve is employed. This functions to prevent flow of fluid from within the drill pipe but permit flow of fluid downwardly into the drill pipe. A second type employs the use of an internal valve which may be opened and closed externally of the sub. This arrangement permits the sub to be opened or closed according to the desire of the operator.

In the present technique the blowout sub is manually positioned in place over the drill pipe and stabbed so that the sub may be rotated to threadably connect it with the drill pipe. Since blowout subs are relatively heavy (approximately 200 pounds for typical 5" o.d. drill pipe), they are very difficult to manually handle. Usually blowout preventer subs are suspended by a cable which extends over a pulley in the drilling derrick. A counterweight is attached to the other end of the cable. This helps provide lifting support for the blowout preventer sub, and if there is no blowout conditions taking place, the sub can be positioned by workmen over the drill pipe and rotated into threaded engagement with the pipe. On the other hand, if blowout is occurring in which fluid, gases or drilling mud may be rapidly discharged from the interior of the drill pipe, it is exceedingly difficult for workmen to manually position the sub over the drill pipe and lower it into positon for threaded engagement. Obviously the more violent the blowout, the more difficult is the job of stabbing and threading a blowout sub onto a drill pipe.

The present invention is directed towards a device for rapidly positioning, stabbing and rotating an inside blowout preventer sub to a drill pipe to thereby eliminate the problems existing with the present system of manually positioning the blowout sub for attachment.

It is therefore an object of the present invention to provide an improved inside blowout preventer for a drill pipe.

More particularly, an object of the invention is to provide an apparatus for rapidly attaching an inside blowout preventer sub having a lower male thread end to the upper female threaded end of a drill pipe.

Still more particularly, an object of the present invention is to provide a device for removable attachment to an inside blowout preventer sub and including means whereby the device can be rapidly positioned on the upper end of a length of drill pipe and manually actuated to bring the blowout preventer sub into alignment for threadably attaching the sub to the drill pipe, after which the mechanism may be expeditiously removed from the drill pipe and sub permitting further drilling operations.

SUMMARY OF THE INVENTION

This invention is an inside blowout preventer for use on drill pipe and more particularly, an apparatus for rapidly attaching an inside blowout preventer sub to a drill pipe. A known method of preventing an oil and gas well being drilled from blowing out the interior of the drill pipe is to have available a blowout preventer sub which is in the form of a small length of drill pipe having lower male threads which can be threaded into the female thread of the drill pipe. The blowout preventer sub includes either a check valve or an externally closable valve. The problem is that when the well is in the process of blowing out it can be extremely difficult for workmen to place the blowout preventer sub in position and thread it onto the drill pipe. The present device includes an assembly by which the attachment of the blowout preventer sub is greatly expedited and includes a collar attached on the exterior of the blowout sub. A horseshoe member is dimensioned to slidably engage a drill pipe below the upset end of the pipe and to slide on the pipe and be restrained by the upset end. A telescopic frame is attached at its upper end to the collar and at its lower end to the horseshoe assembly. An arm is pivotally attached at an intermediate point to the frame. The arm has a hand engaging means at one end and the other end is affixed to one end of a linkage. The other end of the linkage is affixed to the horseshoe member. The whole assembly of the blow out sub, the collar, the horseshoe assembly, the arm and linkage is supported by a cable which is counterweighted. When workmen desire to attach the blowout sub, the assembly is positioned over the drill pipe with the horseshoe member placed on the drill pipe below the upset end. The arm is pivoted down by the workman drawing the blowout preventer sub downwardly into engagement with the drill pipe after which the sub may be rotated by the operator turning the arm, to threadably attach the sub to the drill pipe, after which, the collar may be separated and the entire assembly removed from engagement with the blowout sub.

DESCRIPTION OF THE VIEWS

DETAILED DESCRIPTION

Figure 1:
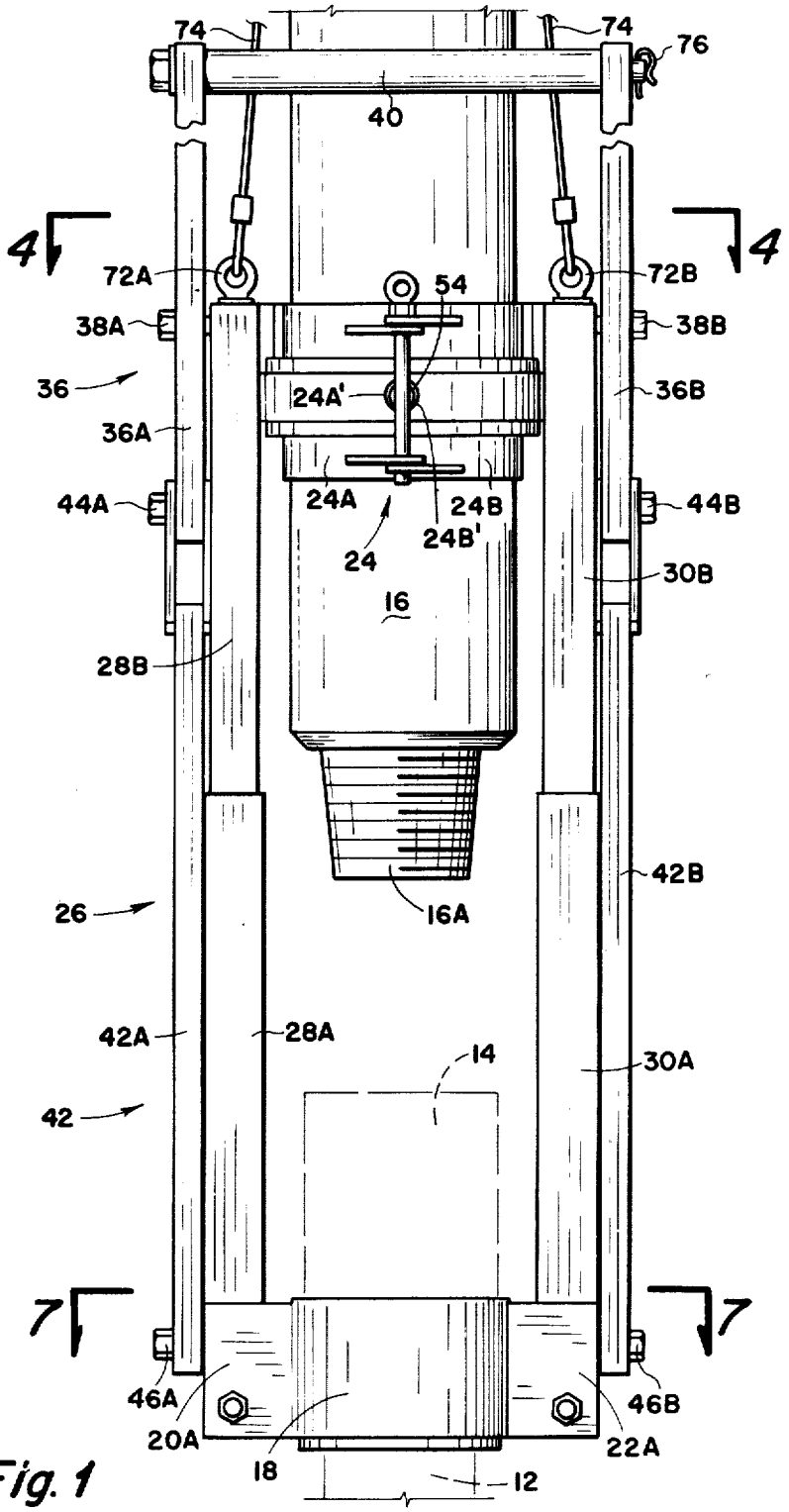
FIG. 1 is a front elevational view of an embodiment of the invention shown affixed to a drill pipe illustrated in dotted outline, and showing the blowout sub positioned above the drill pipe in the first step of attaching the blowout sub to the drill pipe.
Figure 2:
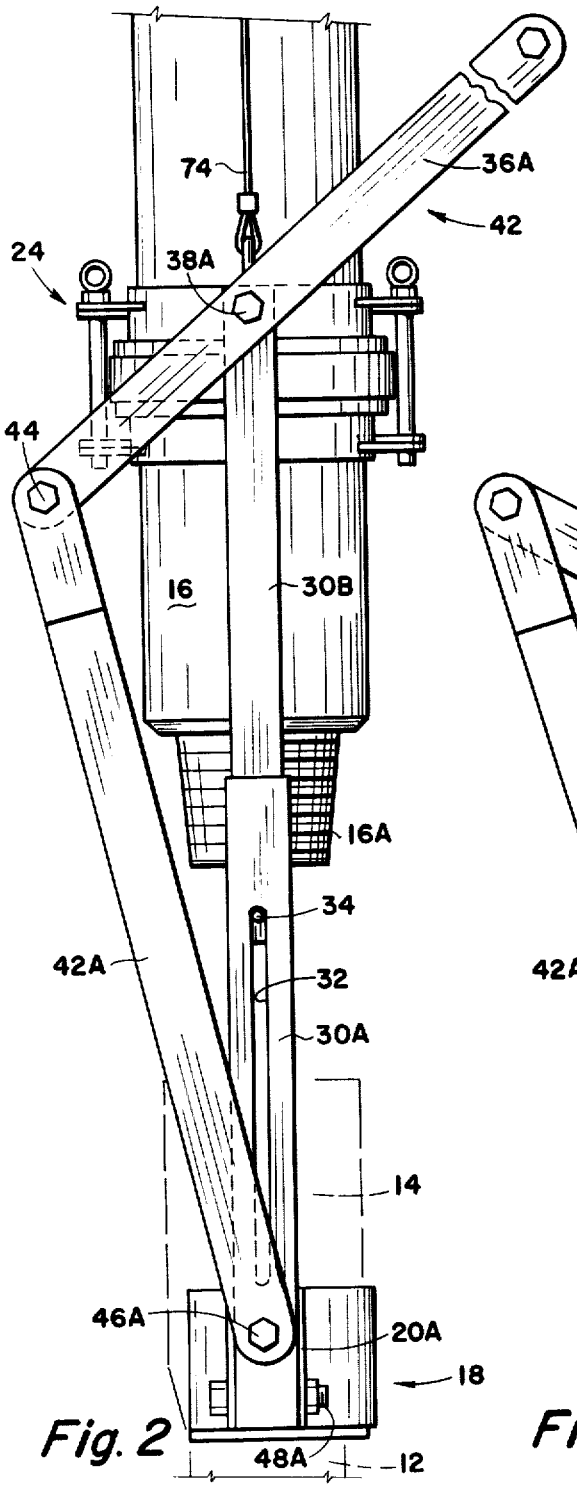
FIG. 2 is a side elevational view of the invention in the attitude as shown in FIG. 1 with the blowout sub positioned above the drill pipe.
Figure 3:
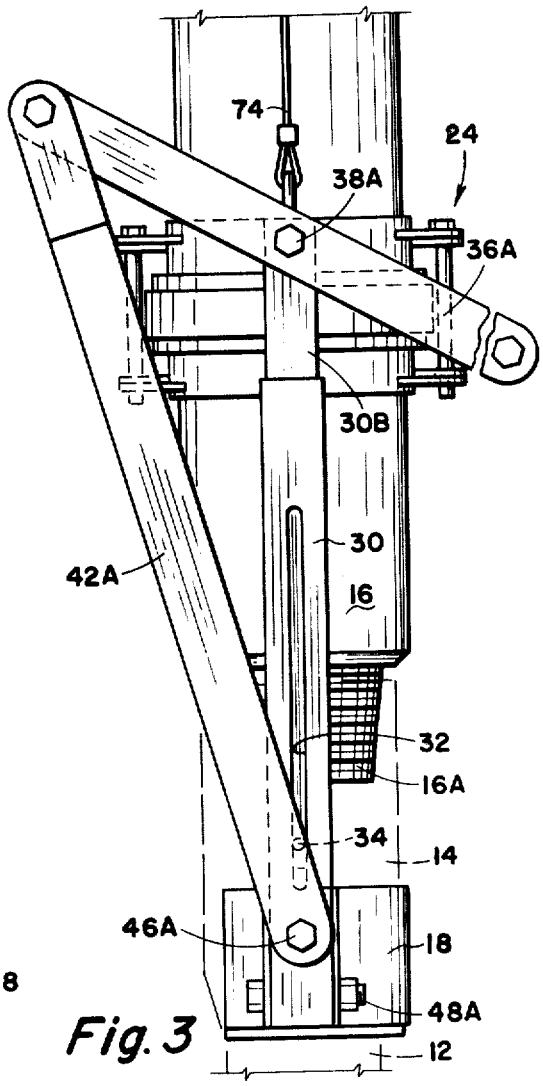
FIG. 3 is a side elevational view as shown in FIG. 2 but with the arm pivoted downwardly to draw the blowout sub into engagement with the drill pipe.

Referring to the drawings and first to FIGS. 1, 2 and 3, a preferred embodiment of the invention is illustrated. A drill pipe 12 (sometimes called a tool joint) is indicated in dotted outline of FIG. 1. The drill pipe consists of a series of lengths of pipe which are threaded together and which have a drill bit (not shown) on the lower end. By mechanism (not shown) employed in a drilling rig, the drill pipe is rotated and thereby the bit is rotated to drill a hole in the earth to seek oil and gas. The drill pipe 12 is tubular and drilling fluid is pumped down through the interior of the drill pipe, the drilling fluid flowing out through the drill bit and back up the annular area around the drill pipe. When a high pressure formation is encountered during drilling operations some means must be provided to contain the pressure. For this purpose outside blowout preventers are frequently employed (not shown) which engage the exterior of the pipe 12. This is used to control blowout which may occur in the drilled hole in the annulus around the drill pipe. The same formation pressure which tends to blow out the well annular area is applied to the interior of drill pipe 12, and therefore if a blowout occurs or is threatened during a period when the drill pipe is standing with the top open, such as occurs when a length of drill pipe is being added or removed from the drill string, such means must be provided for capping the interior of the drill pipe 12.

The present invention is directed towards a method of providing an inside blowout preventer on the top of drill pipe 12.

Drill pipe in present use includes an enlarged external diameter upset end 14. An inside blowout preventer sub 16 is a known device used to close the upset end 14 of a drill pipe. The blowout sub is normally a short length of drill pipe having an external diameter no greater than the external diameter of the drill pipe upset end 14 and has an externally threaded lower end 16A dimensioned to threadably engage the female threads of upset end 14. Sub 16 may include either a check valve which automatically closes when fluid pressure is applied tending to blow upwardly through the sub or may include a valve which is controllable by external means. Since blowout preventer subs 16 are well known in the industry, the interior configuration is not shown, and such forms no part of the present invention. The objective of this invention is to provide a means for quickly aligning and threadably attaching sub 16 to the upset end 14 of a drill pipe in the event of a blowout or impending blowout.

Figure 7:
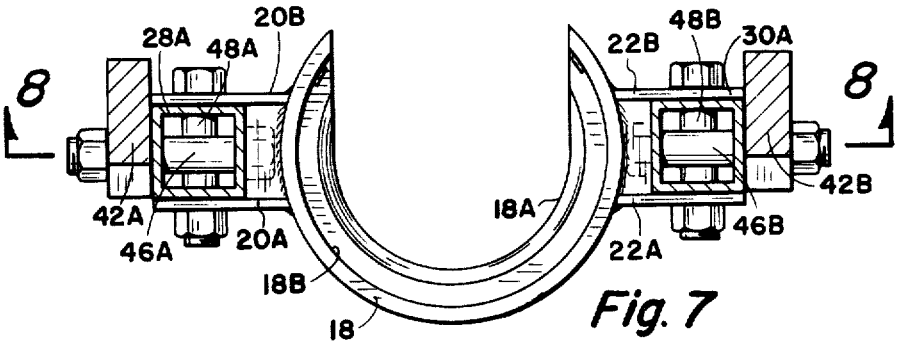
FIG. 7 is an elevational view of the horseshoe member as taken along the line 7—7 of FIG. 1.

A horseshoe member 18 is dimensioned to slidably engage drill pipe 12 and to be restrained by the upset end 14. Referring to FIG. 7, it can be seen that the horseshoe member 18 is substantially U-shaped and includes a lower portion 18A of an internal diameter slightly greater than the external diameter of drill pipe 12 but less than the external diameter of upset end 14. The upper interior portion of the horseshoe member 18B is of an external diameter slightly greater than the diameter of upset end 14. The horseshoe member 18 can be slidably positioned onto drill pipe 12 and when moved upwardly for engagement with the lower end of the upset end 14, the upper enlarged internal diameter portion 18B engages the upset end and as long as upward pressure is applied on the horseshoe member, it cannot be laterally dislodged from the drill pipe.

The horseshoe member includes left boss portions 20A and 20B and opposed right side boss portions 22A and 22B.

Returning again to FIGS. 1, 2 and 3, a collar generally indicated by the numeral 24 is attached to the blowout sub 16 at a point intermediate its top and bottom end. The collar 24 will be described in detail subsequently. Extending from the horseshoe member 18 to collar 24 is a telescoping frame generally indicated by the numeral 26. The frame includes a left-hand and a corresponding right-hand portion. The left-hand portion as seen in FIG. 1 includes a lower portion 28A which may be constructed of square cross-sectioned tubing, and an upper portion 28B which may be also of square cross-section tubing of a reduced external dimension so that the upper portion 28B is freely slidable in lower portion 28A. The bottom end of the frame lower portion 28A is attached to horseshoe member boss 20A and 20B and the upper end of the frame upper portion 28B is attached to collar 24. In like manner, the right frame portion includes a lower portion 30A and a telescopingly received upper portion 30B attached to the horseshoe member and collar.

As seen in FIGS. 2 and 3, the frame right lower portion 30A has a slot 32 therein which slidably receives a pin 34 affixed to the lower end of the right frame upper portion 30B. The function of slot 32 and pin 34 is to permit longitudinal displacement of portions 30A and 30B but to limit the upward travel of the portion 30B so that the frame members remain always connected. While not illustrated, the left frame portions 28A and 28B likewise include a slot and pin. It can be seen that the slot 32 may be placed in any one of the four sides of the member 30A.

An arm generally indicated by the numeral 36 includes a left portion 36A and a paralleled right portion 36B as shown in FIG. 1 and is pivotally attached at an intermediate point to the collar 24. The attachment may be as illustrated by means of bolts 38A and 38B connected to the upper end of the frame portions 28B and 30B. One end of the arm 36 includes a hand engaging means in the form of a cylindrical bar 40 which extends from frame member 36A to 36B. The handle 40 is removably attached to the end of arm 36B so that it may be easily separated from the right arm portion for reasons which will be described subsequently.

A linkage, generally indicated by the numeral 42 includes a left-hand portion 42A and a right-hand portion 42B. One end of the linkage left-hand portion is pivotally attached to the end of arm portion 36A opposite handle 40 by means of a bolt 44A. In like manner, linkage right-hand portion 42B is attached at its upper end to the end of arm portion 36B opposite the handle by means of a bolt 44B.

Figure 8:
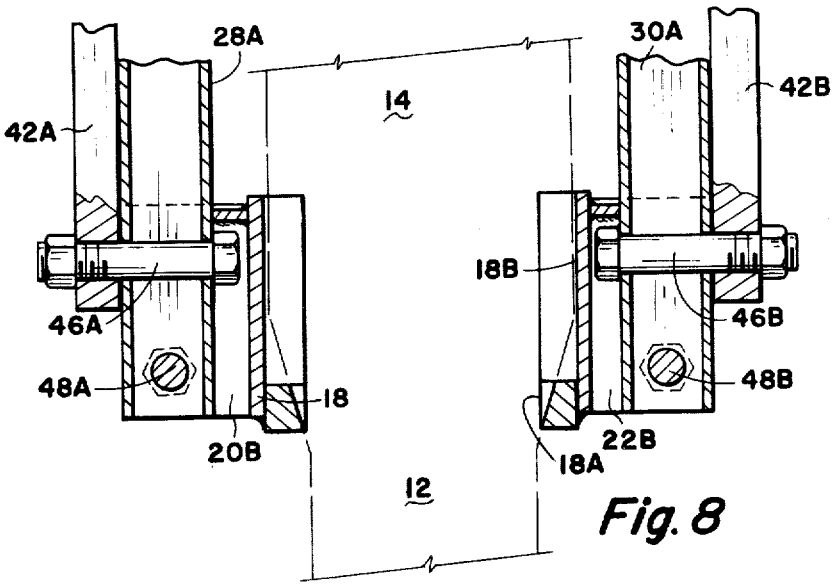
FIG. 8 is a cross-sectional view of the horseshoe member and lower portions of the assembly as taken along the line 8—8 of FIG. 7.

The lower end of left linkage 42A is pivotally attached to the horseshoe member 18 by means of a bolt 46A and the lower end of the right-hand linkage is attached to the horseshoe member by means of bolt 46B. As shown more particularly in FIGS. 7 and 8, bolt 46A extends through openings in the lower end of left lower frame portion 28A and bolt 46B extends through an opening in the lower end of the lower right frame portion 30A. A bolt 48A attaches the lower end of left lower frame portion 28A to the left horseshoe member boss portions 20A and 20B, and in like manner, a bolt 48A attaches the lower end of right lower frame portion 30A to the horseshoe member bosses 22A and 22B. The nuts attached to their respective bolts are not independently numbered since their function is obvious and the nuts are considered part of the bolt for purposes of this description.

Figure 9:
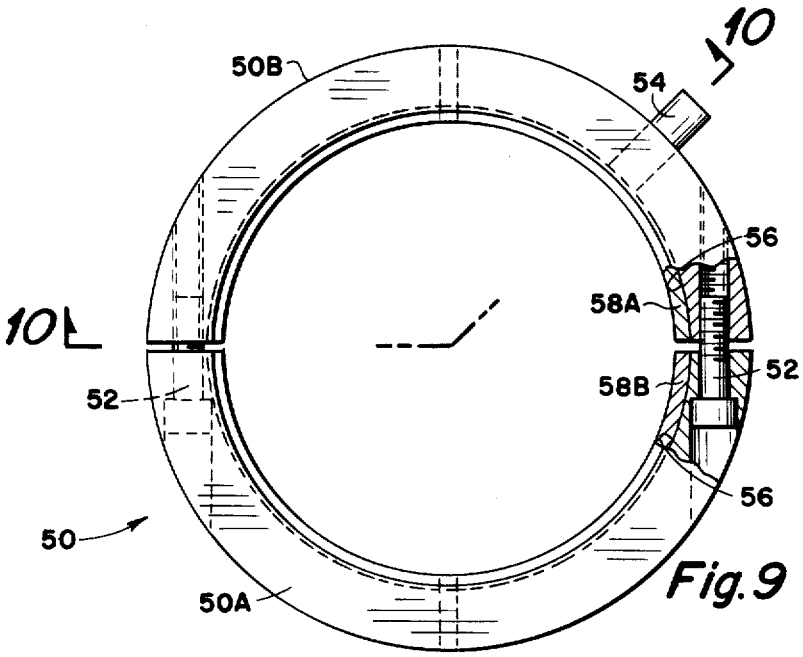
FIG. 9 is a plan view of a ring which is attached to a drilling sub at a point intermediate its end by which the drilling collar is supported, the ring being shown partially in cross-section.
Figure 10:
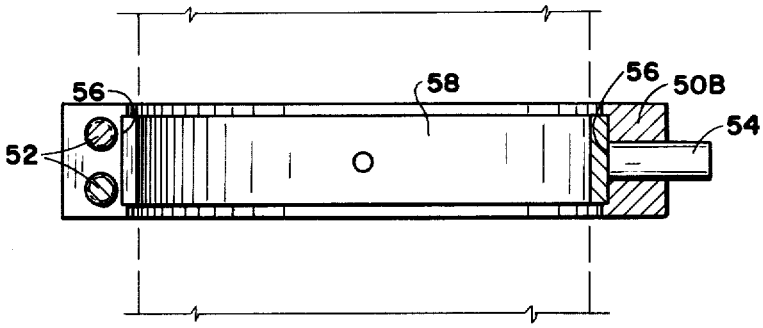
FIG. 10 is a cross-sectional view of the ring as taken along the line 10—10 of FIG. 9.

To removably support the collar 24 to the blowout sub 16 a ring is attached to the blowout sub, the ring being illustrated in FIGS. 9 and 10, the ring being indicated generally by the numeral 50. The ring is bifurcated including portions 50A and 50B. Bolts 52 are employed to hold the ring together when assembled on the exterior surface of a blow out sub, the heads of bolts 52 being recessed so that the external diameter of the ring 50 is not altered. A torque pin 54 extends radially from ring segment 50B for purposes of which will be described subsequently.

Figure 4:
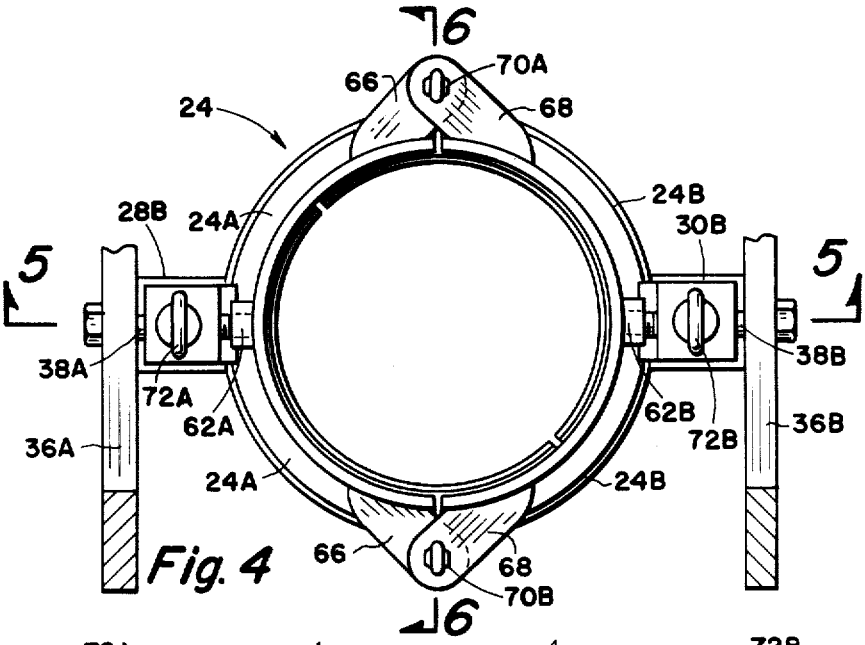
FIG. 4 is a top plan view taken along the line 4—4 of FIG. 1.
Figure 5:
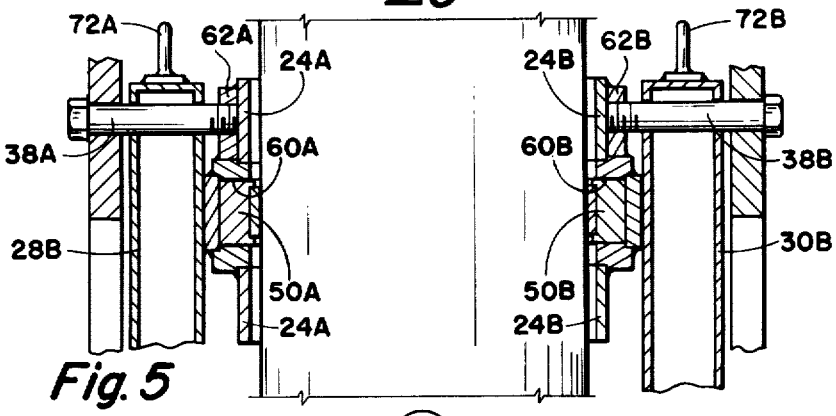
FIG. 5 is a cross-sectional view of the collar and upper portion of the assembly as taken along the line 5—5 of FIG. 4.
Figure 6:
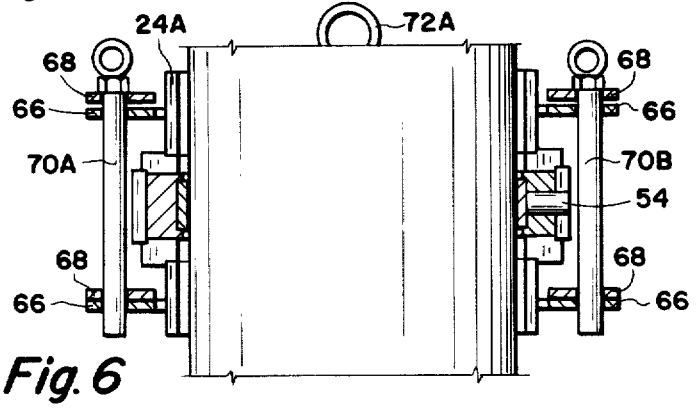
FIG. 6 is a cross-sectional view of the collar as taken along the line 6—6 of FIG. 4.

Referring to FIGS. 4, 5, and 6, the details of the collar are best illustrated. Collar 24 is bifurcated and, in plan view of FIG. 4, includes a left-hand portion 24A and a right-hand portion 24B. Each collar portion includes a semi-circular member having an internal diameter substantially equal the external diameter of the blowout sub 16. Ring semi-circular portion 50 includes an enlarged internal diameter recess 56 which receives a semi-circular ring 58A which has an internal diameter matingly engaging the blowout sub 16. In like manner, the ring semi-circular portion 50B includes an inner ring 58B.

Collar body portion 24A includes a recess 60A dimensioned to receive ring 50, or more precisely, one of the ring semi-circular portions 50A and 50B. In like manner, the right-hand semi-circular collar portion 24B has a recess 60B to receive the ring semi-circular portions 50A and 50B. The collar semi-circular portions 24A and 24B are fabricated of separate semi-circular elements welded together in the illustrated arrangement, and the individual elements are not separately numbered since it can be seen that the collar may be fabricated in a number of ways to removably engage the ring 50 attached to the exterior of the drill sub.

A boss 60A is attached to the left collar portion 24A which has an opening threadably receiving a bolt 38A which serve not only to support the collar left portion 24A to the upper end of left frame upper portion 28B but also to pivotally attach arm left portion 36A. In like manner, a boss 62B attached to the collar right portion 24B receives bolt 38B for attachment of the right collar to the upper end of the right frame upper portion 30B and pivotally attach the arm portion 36B.

As shown best in FIGS. 4 and 6, the left collar portion 24A includes hinge leaves 66 extending from opposite sides of the semi-circular collar portion adjacent the top and bottom, and in like manner, the right-hand collar of FIG. 4 includes opposed pairs of hinges 68 affixed to the top and bottom of the opposed sides of the collar 24B. The hinges 66 and 68 have aligned openings which receive pins 70A and 70B so that when the hinge pins are in place the collar portions are secured about the blow out sub 16 and about ring 5. When the hinge pins 70A and 70B are removed, the collar may be separated for complete disengagement with the blowout sub 16.

An eyelet 72A is secured to the top of left frame upper portion 28B, and in like manner, eyelet 72B is secured to the right frame upper portion 30B. A cable harness 74 is employed, the lower ends of which are secured to eyelets 72A and 72B. Cable harness 74 extends upwardly and is attached to a cable (not shown) which extends to a pulley (also not shown) in the drilling mast in which the device is used, the other end of the cable being attached to a counterweight (also not shown). In this manner the weight of the entire assembly, including blowout sub 16, is swung from a cable by cable harness 74 and the weight is supported so that it is not difficult for workmen to raise and lower the entire assembly including the drilling sub when installing it on a drill pipe 12.

OPERATION

The inside blowout preventer is suspended on cable harness 74 balanced by a counterweight and is positioned off to the side of the drilling rig so as to be out of the way of the normal drilling operation. When it becomes necessary to install the inside blowout preventer, such as when it is feared that a blowout is eminent or, while one is occurring, the workmen on the drilling floor move the preventer into position. The elevation may be easily adjusted up and down since the counterweight is selected so as to balance the weight of the entire assembly, including the blowout sub 16.

The arm 42 is moved upwardly to the position as shown in FIG. 2, and the horseshoe member 18 is slid onto drill pipe 12 below upset end 14. The lower internal portion 18A of the horseshoe member engages the exterior surface of pipe 14. When in this position the blowout sub 16 is suspended above the upper end of drill pipe upset end 14. Arm 42 is then moved downwardly towards the position shown in FIG. 3 by downward force on handle bar 40. This moves the blowout sub 16 downwardly so that the lower male threaded end 16A engages the upper female internally threaded upset end 14. In this position the sub 16 may be threaded onto the drill pipe by rotating the entire assembly. This is accomplished by the workmen holding handle 40 and walking around the drill pipe 12 until the blowout sub 16 is securely threaded into the drill pipe upset end 14. The length of arm 42 provides high leverage so that the sub may be threadably secured to the drill pipe. The torqueing pin 54 extending from the ring 50 affixed to the blowout sub transmits torque from collar 24.

After the blowout sub 16 is in position, the flow of fluid or gases from within the drill pipe can be terminated. If the sub 16 is of the type having a check valve therein, as soon as the sub is fixed in position on the drill pipe, no further escape of fluid or liquids will occur. If the sub 16 is the type having a valve therein, then the valve may be closed, terminating flow.

Figure 11:
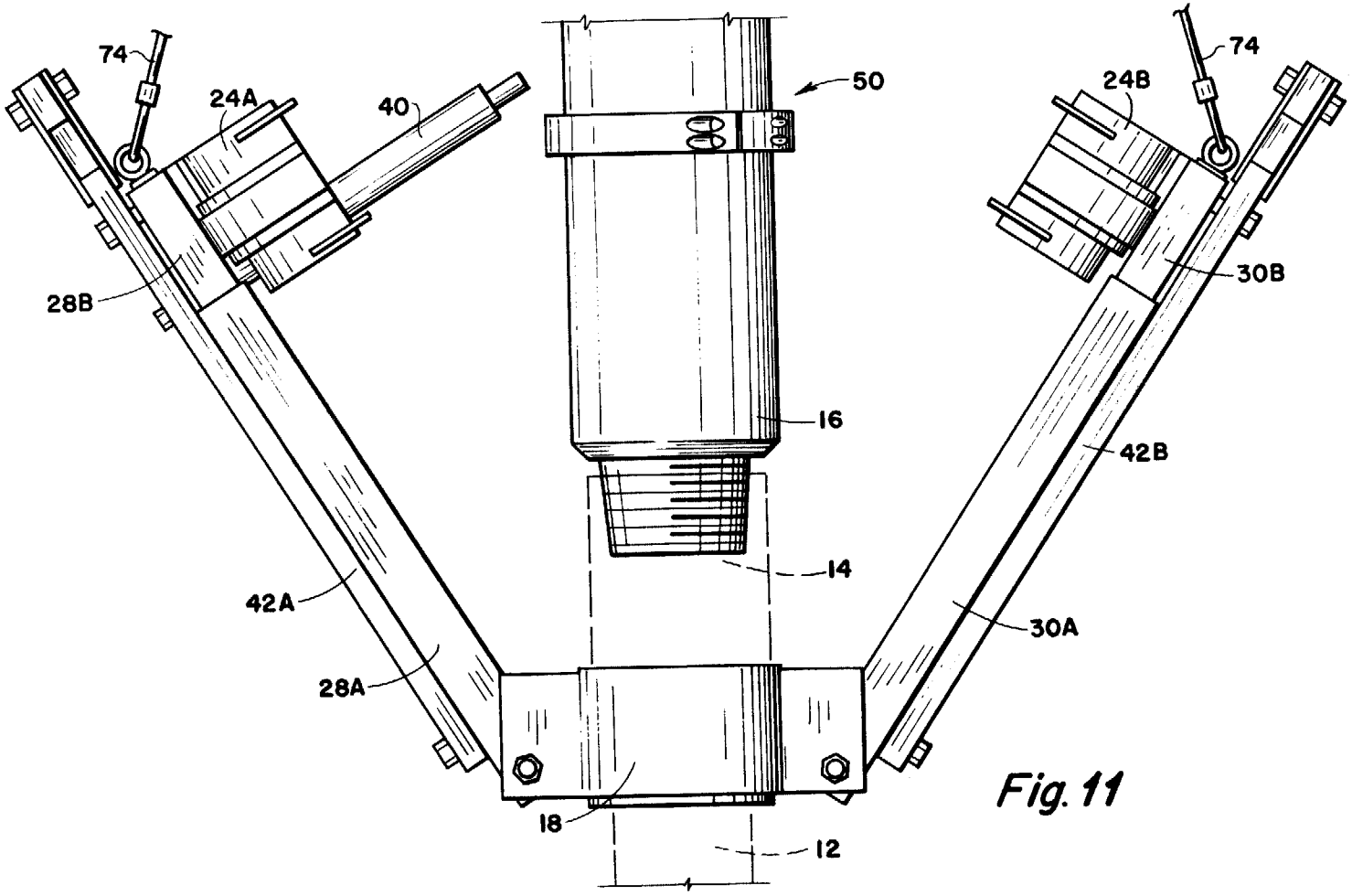
FIG. 11 is an elevational view of the device showing the relative position of the components after the blowout sub has been attached to the drill pipe and after the bifurcated collar has been separated by spreading the frame members and arm portions apart showing a step in the removal of the device after the blowout preventer sub has been installed.

After the blowout sub is installed on the drill pipe and the flow terminated, the assembly may be expeditiously removed from the drill pipe for further operations. This is accomplished by removing pins 70A and 70B from the collar hinge plates 66 and 68, and by removing a key 76 from the end of handle 40. With these elements removed, the portions of the assembly may be separated as shown in FIG. 11. As soon as the collar 24 is disengaged from ring 50, the assembly may be lowered to disengage the horseshoe member 18 from the lower end of drill pipe upset end 14. The assembly then is completely removed from the sub 16 except for ring 50 which is easily removed by loosening bolts 52.

It is noted in reference to FIG. 11 that the left and right frame portions are free to pivot outwardly relative to each other by the pivoted engagement with the horseshoe assembly but always in a plane of the axis of the internal portions 18A and 18B of the horseshoe member so that when the frame and the collar are attached to the blowout sub it is held in alignment with the horseshoe member to ensure that when the horseshoe member is secured to the lower surface of a drill pipe upset end the sub is held in correct alignment.

Thus the device provides an expeditious means of quickly attaching a drill sub to a pipe by affording a mechanical means of alignment with the pipe and by providing a mechanical leverage for forcing the sub into position for threaded engagement with the drill pipe. In addition, once in position for threaded engagement, the device provides a wrenching arrangement for rotating the sub for secure engagement with the drill pipe.

While the invention has been described with a certain degree of particularity, it is manifest that many changes may be made in the details of construction and the arrangement of components without departing from the spirit and scope of this disclosure. It is understood that the invention is not to be limited to the embodiments set forth herein for purposes of exemplification, but is to be limited only by the scope of the attached claim or claims, including the full range of equivalency to which each element thereof is entitled.

What is claimed:

1. An inside blowout preventer for a drill pipe, the drill pipe having an enlarged external diameter internally threaded upset end portion, comprising:

a blowout sub having a lower and threadably engageable with the drill pipe upset end;

a horseshoe member dimensioned to slidably engage a drill pipe below the upset end and slid on the pipe and be restrained by the upset end;

a collar attached to said blowout sub;

telescoping frame attached at its upper end to said collar and at the lower end to said horseshoe assembly;

an arm pivotally attached at an intermediate point to said collar, the arm having a hand engaging means at one end; and a linkage pivotally attached at its first end to the other end of said arm, the second end of the linkage being pivotally attached to said horseshoe member, whereby said blowout sub is positioned above a drill pipe upset end, said horseshoe member may be engaged with the drill pipe and the pivotation of said handle move said collar downwardly towards said horseshoe member to engage the lower threaded end of said blowout sub with the drill pipe upset end and the entire assembly rotated relative to the drill pipe to thread said blowout sub into the drill pipe upset end.

2. An inside blowout preventer for a drill pipe according to claim 1 wherein said collar is bifurcated and releasably attachable to said blowout sub whereby after the blowout sub is treadably attached to a drill pipe, said collar means, horseshoe assembly, frame, arm and linkage may be removed.

3. An inside blowout preventer for a drill pipe according to claim 2 wherein said frame is formed of two portions, the portions being attached to opposite sides of said collar and said horseshoe member and arm and said linkage in like manner each consists of two parts supported in paralleled arrangement.

4. An inside blowout preventer according to claim 2 including:

a ring removably attached to the exterior of said blowout sub intermediate its ends, and wherein said bifurcated collar, when assembled, provides an internal circumferential groove receiving said ring.

5. An apparatus for rapidly attaching an inside blowout preventer sub having a lower male threaded end to the upper female threaded upset end of a drill pipe comprising:

a collar removably attached to the blowout sub;

a horseshoe member slidably positionable on the drill pipe and engageable with the lower portion of the drill pipe enlarged diameter upset end;

a telescoping frame interconnecting said collar and horseshoe member;

an arm and linkage means pivotally attached to said telescoping frame for moving said collar and the blowout sub attached to the frame towards said horseshoe member and thereby the drill pipe upset end, whereby the drill sub may be rotated to threadably connect it with the drill string.

6. An apparatus for rapidly attaching a blowout preventer to a drill pipe according to claim 5 wherein said collar is bifurcated, the bifurcated portions being releasable from each other whereby the collar is detachable from the blowout sub.

* * * * *